106-18.12 SR
3/15/83 XR 4,376,674

United States Patent [19]
Ali

[11] 4,376,674
[45] Mar. 15, 1983

[54] METHOD OF MANUFACTURING FLAME AND ABUSE RESISTANT FIBER PANEL AND PRODUCTS RESULTING

[75] Inventor: Mohammad H. Ali, Chicago, Ill.

[73] Assignee: United States Gypsum Company, Chicago, Ill.

[21] Appl. No.: 248,935

[22] Filed: Mar. 30, 1981

[51] Int. Cl.[3] ..... D21J 5/08
[52] U.S. Cl. ..... 162/136; 162/159; 162/181.2; 162/181.7; 162/184; 428/921; 106/18.12
[58] Field of Search ..... 162/181.7, 181.2, 184, 162/186, 159, 136; 427/344; 428/453, 921; 106/18.12

[56] References Cited

U.S. PATENT DOCUMENTS 1,676,727 7/1928 Carter ..... 428/453
2,008,815 7/1935 Brandenberger et al. ..... 428/453
2,875,044 2/1959 Dunn et al. ..... 162/184

FOREIGN PATENT DOCUMENTS 52-77138 6/1977 Japan ..... 106/18.12
55-9871 1/1980 Japan ..... 428/453

*Primary Examiner*—William F. Smith
*Attorney, Agent, or Firm*—Kenneth E. Roberts; Robert H. Robinson; Samuel Kurlandsky

[57] ABSTRACT

A method of manufacturing flame and abuse resistant fiber panels by treating the surface of water-laid fiber mats with an aqeuous slurry of sodium silicate and calicum carbonate and drying the mats is disclosed. The slurry is applied to the wet mat after wet pressing and before drying while the mat still contains considerable moisture content. The resulting products present a hard, abuse resistant, flame resistant and water resistant surface.

10 Claims, No Drawings

METHOD OF MANUFACTURING FLAME AND ABUSE RESISTANT FIBER PANEL AND PRODUCTS RESULTING

BACKGROUND OF THE INVENTION

The present invention relates to a method of manufacturing panels of water-laid fibers, preferably wood pulp fibers, which have a surface that is hard, water resistant and flame resistant.

For considerable time now fiber panels have been manufactured by interfelting a water slurry of fibers on a moving collection screen, consolidating and dewatering to form a wet mat, and drying the formed board, with or without optional wet or dry end coating, texturing and the like features. Improving certain of the surface properties by co-manufacturing a denser layer of the core composition is also known in the art. Methods for doing this are described in U.S. Pat. Nos. 3,779,860 and 4,153,503.

Heretofore wood fiber insulation board products produced by these means have been unable to obtain restricted flame spread classifications without expensive metal cladding or general fire retardive agent treatment. Further heretofore such boards have had very limited washability and water resistance due to wicking and retention of moisture into the fiber body.

It has now been discovered that the foregoing limitations may be overcome by the propitious application of a sodium silicate and calcium carbonate slurry.

It is known in general that soluble sodium silicate solutions may be employed as binders in fiber products; see for example U.S. Pat. No. 2,705,198. It is further known to react the silcate to water insoluble forms in certain of such products by adding a highly alkaline reactant such as hydrated lime and moderate heat or an ionic alkaline calcium compound with heat over 600° F.; see for example U.S. Pat. Nos. 2,237,337 and 3,950,218. Philadelphia Quartz Company bulletin T-17-52 indicates resistance to rehydration of soluble silicates may be increased by slow baking to about 200° F. followed by 300°–400° F. curing; higher temperatures may be used to unsolubilize the film; and sometimes permanency may be achieved by reaction with acid or solutions of calcium, magnesium or aluminum salts.

None of these investigations however have reported any evaluation of soluble silicate in combination with a calcium inert filler with short and moderate temperature drying.

Now it has been discovered that important advantages from both the processing viewpoints and the product viewpoints are gained when a still wet water-laid mat is coated with an aqueous slurry of certain soluble silicate solutions filled with particular proportions of calcium carbonate calculated to cause a limited penetration of the wet mat surface without segregation and then confined in medium heat for a short time.

It is an object of this invention to provide a novel method for preparation of a surface coated fiberboard of improved properties and characteristics.

It is another object to provide a wood insulation board having a surface with restricted flame spread characteristics, high modulus of rupture, and high washability approaching that of pre-finished wood hardboard.

It is yet another object of this invention to provide a process for the production of coated fiberboard wherein a soluble silicate coating is rendered insoluable without caustic reactive calcium compounds and lengthy baking or high temperature reactive conversion.

SUMMARY OF THE INVENTION

There is provided by virtue of this invention an improved fiber insulation board material which can be formed during conventional water felting operations without added equipment or repeated steps. The product formed is one comprising a fibrous mat base, containing interfelted fibers and any desirable binder and customary adjuvants, having coated on and penetrating into the mat on at least one surface of the base the dry solids from an aqueous slurry of about 10–40% sodium silicate solids and about 20–60% calcium carbonate solids by weight. The method of obtaining this board involves applying the slurry at the point in board manufacture when the wet mat has about 40–70% moisture content.

DETAILED DESCRIPTION OF THE PREFERRED EMBODIMENTS

In a preferred embodiment of the present invention a lignocellulosic insulation board product that has a flame and water resistant surface is obtained by flooding the wet mat after it has passed the wet press rolls and before it enters the dryer, via the customary primer coating roller with a slurry of calcium carbonate in a soluble sodium silicate solution; and for certain special cases to give exceptional handling and the like, a glass fiber mat or tissue, reinforcing cellulosic fibers, plasticizing resin, and the like may be added.

In accordance with the present invention a water soluble sodium silicate solution is used in forming the slurries. Of course potassium silicate solutions can be utilized but are generally economically disadvantageous when compared to the sodium silicates. The preferred embodiment of the present invention utilizes sodium silicates comprising $SiO_2/Na_2O_3$ weight ratios from about 1.8 to 3.3 that are commonly available in solution form. Preferred solutions have sodium silicates solids contents of about 30–55% by weight and initial viscosities of about 50–500 centipoises (cps) at 70° F. Particularly preferred for blending with the calcium carbonate for use in the present invention are soluble sodium silicate solutions with viscosities of about 60–200 centipoises at 70° F. and silica to alkali ratios of about 2.5–3.3. It was found in the course of development of the present invention that application of such solutions without carbonate filler but application of drying heat as hereinafter set forth resulted in a completely water absorbable board. Pouring a glass of water on a square foot sized piece of such board resulted in the board immediately sopping up all of the water and, after a brief time interval even at room temperature the sample piece curled up at the edges with warpage.

The calcium carbonate may be any of the commonly available grades and ranges of particle sizes as commonly used as a paint filler. The calcium carbonate ingredient is incorporated in the sodium silicate solution by merely mixing the weight proportions of silicate solution and carbonate, of about 40–80% silicate solution (as solution weight, not based on the silicate solids weight) to about 60–20% calcium carbonate by weight. It has been found that the lower limit is a minimum necessary to provide moisture resistance and washability to the product; while the upper limit is a maximum for low flame spread numbers to obtain restricted fire classifications e.g., Class 1 or Class A. Inclusion of less calcium carbonate fillers than called for in the preferred embodiments will not result in a weak bond but will result in warpage upon rewet. Within the range of carbonate, more of the filler is readily mixable into the lower viscosity ranges of the silicate solutions; however it is preferred to use the higher viscosity solutions to provide optimum balance of penetration and surface coverage of the slurry on the fiber. With lower amounts within the range of carbonate filer in the lower viscosity silicate solutions during the practice of the present invention there is an increased tendency for separation of the slurry during drying resulting in a hard and brittle surface with greater tendency towards warpage when exposed to humidity. Within the range, the more carbonate filler added, the more powdery the surface of the board. However with any given viscosity of silicate solution there is a limit to the amount of filler that can be incorporated without the surface cracking upon drying. A precise range of calcium carbonate filler is required within the viscosity ranges specified in order to obtain integration with the felted fiber yet prevent soaking in of the slurry to too great a depth into the fibrous body mass.

This slurry is applied at about 50–120 pounds of slurry per thousand square feed of mat surface. As indicated hereinbefore the slurry is applied after the press rolls and before the customary drying ovens. The important aspect in this is that the mats have a moisture content of between about 40–70% by weight. Generally after the initial dewatering prior to press rolls the consolidated fibrous mat will have a moisture content above 80%; and application thereat results in too much penetration and insufficient surface retention of the components of the slurry not achieving the objectives of the present invention. After the customary press rollers the mat will have a moisture content of less than about 60% and this is quite suitable for the present process. The slurry is flooded on the wet mat to provide, when dried, an about 1–3 mil covering upon the surface of the board that penetrates about 1–2 mils into the upper most fibers of the mat.

Following application of the slurry, the wet board is passed to the dryers for drying at convention times and temperatures for the thickness of the particular mat, as illustrated in the hereinafter examples.

EXAMPLE 1

A dilute acqueous slurry of lignocellulosic fiber and binder and other adjuvants conventional to the formation of ½ and ⅜th inch thick and about 10–30 pound per cubic foot density wood fiber insulation board was fed onto the collecting screen of a Fourdrinier machine, and also of an Oliver drum, to form water-laid mats of multiple layers of fibers. The consolidated mats were dewatered and wet roller pressed to a moisture content of 60% by weight as the mat was approaching the coating roller. Different soluble sodium silicate solutions were mixed with calcium carbonate in the ratios indicated in the table and flooded behind the primer coating roll using one, and in some cases two primer rolls. The mat then passed to the conventional number of drying ovens; in the case of ⅜" mat the drying time was 45 minutes and in the case of ½" mat the drying time was about almost 1½ hour in graduated temperature drying ovens. The drying ovens were arranged so that the hottest, about 300°–400° F., was the first zone lasting about 20–45 minutes and thereafter decreasing temperatures were utilized in the subsequent drying zones. The dried boards were sampled for physical properties as set forth in the table. In addition samples of the boards were submitted to X-ray diffraction analysis to determine the formation of any crystalline compounds. The results of this evaluation determined that no crystalline calcium silicate reaction products had formed; the only crystalline structure indicated was that of the initial calcium carbonate.

In another evaluation a 4 grams per square foot weight of woven fiberglass mat was overlaid onto the wet mat surface prior to flooding the surface with the slurry; and, as shown in the table, an even tougher surface was provided. In addition it was found that even a small quantity of water mixed with either the sodium silicate solution or the suspension resulted in severe warping of the mat after drying.

The slurry may contain customary adjuvants for modifying surface characteristics in special cases. For example pigments may be added to give colorizing of the surface. The surface on the panel, quite hard and somewhat brittle, may be made more ductile by the addition of plasticizers to the silicate solutions; such as for example about 1–5% by weight of glycerin or sugar solutions, the addition of sorbitol or sorbitol solutions and various rubber latexes in variable amounts depending on the degree of flexibility desired and the like. When such more ductile surfaces are formed, the surface may be textured, before or after drying. The customary paint and other protective coatings may be applied to the face or back portions of the panel. For example 1–5 mil polyethylene plastic films may be applied to the back as a vapor barrier or to the face surface as a decorative feature.

The fiber slurry for mat formation may be any conventional board-forming slurry of wood fibers, mineral fibers or a mixture of the two and containing binder material such as starch to be processed by water felting in a conventional manner. Any of the various board forming machines including the Fourdrinier machine and rotary vacuum filters or cylinder-type board machines that operate continuously may be employed in forming the boards described herein.

TABLE

| | Treatment | Coverage | Modulus of Rupture | Surface Hardness[a] | Flame Spread[b] | Washability[c] |
|---|---|---|---|---|---|---|
| 1. | Untreated Control | — | 258 psi | 1 Kg | 152 | Zero |
| 2. | Slurry 50% $CaCO_3$ 50 NaSil* | 110.2 lb/ft$^2$ of Surface | 250 psi | 4.3 Kg | 0 | 4000 cycles |
| 3. | Slurry 35% $CaCO_3$ 65% NaSil** | 83.8 lb/ft$^2$ of Surface | 284 psi | 4 Kg | 0 | 4000 cycles |
| 4. | #3 Plus 10 Mil Thick- | | | | | |

TABLE-continued

| | | | | | |
|---|---|---|---|---|---|
| ness of 4g/sq. ft. Fiber Glass Mat | 92.6 lb/ft$^2$ of Surface | 287 psi | 12.1 Kg | 0 | 4000 cycles |

SURFACE BURNING CHARACTERISTICS, ASTM E-84 TEST METHOD

| Treatment | Flame Spread | Fuel Contributed | Smoke Developed |
|---|---|---|---|
| 5. #3 | 1.48 | 0 | 6.4 |
| 6. Untreated Control | 150.00 | 7% | About 19 |

NOTES:
*Star Grade 37.5% Solids Sodium Silicate Solution; 2.5 Wt. Ratio $SiO_2/Na_2O_3$; 60 cps Viscosity at 70° F.
**N Grade 38.3% Solids Sodium Silicate Solution; 3.22 Wt. Ratio $SiO_2/Na_2O_3$; 180 cps Viscosity at 70° F.
[a]Monotron Hardness Test Using 8mm round head pin penetrating 0.01 inch
[b]Heylin Tunnel Test Method
[c]ASTM D2486-69T

What is claimed is:

1. A process of manufacturing a flame resistant and water resistant surface on a fiberboard panel comprising:

forming a water-laid mat of multiple layers of fiber, to have a moisture content between about 40–70% by weight of water;

coating a surface of the wet mat with an aqueous slurry of about 20–60% by weight calcium carbonate and about 80–40% by weight sodium silicate solution; said silicate solution having a weight ratio of $SiO_2/Na_2O_3$ ranging between about 2.5 and 3.3, having an alkali silicate solids weight content between about 30% and 55%, and having a viscosity between about 50 and 500 centipoises at 70° F.;

and drying the coated mat at a temperature between about 300° and about 450° F.

2. The process of claim 1 in which the sodium silicate solution has a $SiO_2/Na_2O_3$ weigh ratio of about 2.5.

3. The process of claim 1 in which the sodium silicate solution has a $SiO_2/Na_2O_3$ weight ratio of about 3.2.

4. The process of claim 1 in which the sodium silicate solution has an alkali silicate solids weight content of about 38%.

5. The process of claim 1 in which the sodium silicate solution has a viscosity at 70° F. between about 60 cps and 200 cps.

6. The process of claim 1 in which the slurry contains about 50 weight % calcium carbonate.

7. The process of claim 1 in which the slurry contains about 35 weight % calcium carbonate.

8. The process of claim 1 in which the mat is coated with about 50–120 pounds per thousand square feet of mat surface with an aqueous slurry comprising about 35 weight % calcium carbonate and about 65 weight % of a sodium silicate solution having a $SiO_2/Na_2O_3$ weight ratio of about 3, having an alkali silicate solids content of about 40% and having a viscosity at 70° F. of about 200.

9. The process of claim 1 in which said fiber is cellulosic fiber and said fiberboard is a wood fiber insulation board.

10. A fiberboard product having a flame and water resistant surface comprising a wood fiber insulation board mat having coated on at least one surface thereof the dry solids from the application of an aqueous slurry containing by weight about 20–60% calcium carbonate solids and about 10–40% sodium silicate solids having a $SiO_2/Na_2O_3$ weight ratio of between about 2.5 and 3.3 to the board mat when the mat contains about 40–70 weight % moisture and dried at a temperature between about 300° and about 450° F.

* * * * *